US006152065A

United States Patent [19]

Grönstrand

[11] Patent Number: 6,152,065

[45] Date of Patent: Nov. 28, 2000

[54] APPARATUS FOR LAUNCHING AND RECOVERY OF BOATS

[76] Inventor: Jan Grönstrand, Kråkbärsgatan 7, SE-234 43 Lomma, Sweden

[21] Appl. No.: 09/171,336

[22] PCT Filed: Apr. 18, 1997

[86] PCT No.: PCT/SE97/00657

§ 371 Date: Oct. 15, 1998

§ 102(e) Date: Oct. 15, 1998

[87] PCT Pub. No.: WO97/39940

PCT Pub. Date: Oct. 30, 1997

[30] Foreign Application Priority Data

Apr. 22, 1996 [SE] Sweden ..... 9601535

[51] Int. Cl.[7] ..... B63B 23/00

[52] U.S. Cl. ..... 114/365; 114/258; 114/44; 114/51; 114/52; 114/53; 405/1; 405/3

[58] Field of Search ..... 114/258, 259, 114/260, 365, 44, 45, 48, 49, 50, 51, 52, 53; 405/1, 3, 4, 7

[56] References Cited

U.S. PATENT DOCUMENTS

| | | | |
|---|---|---|---|
| 1,300,954 | 4/1919 | Gray | 114/45 |
| 2,390,300 | 12/1945 | Harris | 114/45 |
| 4,018,179 | 4/1977 | Rutter | 114/45 |
| 4,271,553 | 6/1981 | Korsvik | 9/14 |
| 4,970,980 | 11/1990 | Eisner | 114/219 |
| 5,249,545 | 10/1993 | Gettman | 114/259 |
| 5,267,811 | 12/1993 | Evans | 405/1 |
| 5,485,798 | 1/1996 | Samoian et al. | 114/44 |

FOREIGN PATENT DOCUMENTS

| | | | |
|---|---|---|---|
| 2528005 | 12/1993 | France | 114/45 |
| 141929 | 2/1980 | Norway . | |
| 162184 | 9/1988 | Norway . | |
| 2150903 | 7/1985 | United Kingdom . | |

OTHER PUBLICATIONS

English summaries of attachements (BILAGA) 1–4 of opposition document of SE 9601535–9 of Apr., 1996.
English Abstract of JP 52–126890 of Oct. 1977.

*Primary Examiner*—S. Joseph Morano
*Assistant Examiner*—Ajay Vasudeva
*Attorney, Agent, or Firm*—Ladas & Parry

[57] ABSTRACT

A dock, for launching and recovery of a lifeboat, rescue boat or like small boat on a vessel, a floating platform or a fixed installation. The boat (14) is normally stored on the dock. The dock is provided with buoyant elements (1) fixed to a frame (3). The boat (14) is supported in a cradle (2) within the frame (3). On launching and recovery of the boat (14), the dock is lowered to a floating position on the surface of the water. In order to fix the boat (14) to the dock, a locking device (9, 15) is provided. By modifying the configuration and size of the buoyant elements, the dock is given rolling and pitching periods which coincide as closely as possible with those of the boat (14). The dock and the boat (14) will thereby behave in approximately the same manner in the water, which makes it relatively simple to run the boat (14) into the dock even in a very heavy sea. When the boat (14) has been introduced into the dock, it is in contact with the dock at least two points, and the boat (14) and the dock are then fixed to one another by a locking device (9, 15) to form a cohesive unit.

25 Claims, 5 Drawing Sheets

APPARATUS FOR LAUNCHING AND RECOVERY OF BOATS

FIELD OF THE INVENTION

The present invention relates to an apparatus for launching and recovery of a lifeboat, rescue boat or like small boat on a vessel, a floating platform or a fixed installation such as, for example a harbor pier. In order to facilitate this description, the expressions "boat" and "vessel" will be principally employed below, it being understood that the expression "boat" encompasses pick-up boats, lifeboats, rescue boats etc. and that the expression "vessel", also encompasses a platform, pier etc.

BACKGROUND

One problem in the launching and recovery of boats on vessels is that, because of the difference in size, the vessel and the boat move differently in the water. As a result, there will be large relative movements between the vessel and the boat. In addition, waves are often built up to a greater height along the side of the vessel than they would otherwise do, which gives additional large relative movements between the vessel and the boat.

Today, boats on board vessels are normally suspended in davits with whose aid the boats are launched in the water. Conventional davits are primarily intended for launching and function less satisfactorily when retrieving a boat in a high sea. On some vessels, a crane may be used for launching and recovery of a boat.

Lifeboats are normally suspended at two points by wires operated by the davit winch. In a number of systems for pick-up of boats, a single-point attachment is employed. When, on launching and recovery of a boat, hooks are attached or released from the boat, there is a risk that the generally heavy hooks and blocks connected to them may hit the boat because of the large relative movement between the vessel and the boat. Moreover, in systems employing two lifting points, there is the risk that only one hook is disengaged/engaged, in which event the boat runs the risk of being left hanging vertically along the side of the vessel, depending upon what direction the relative vertical movement between the boat and the vessel takes. Even if the crew is successful in attaching or disengaging the hooks from the boat, there is moreover the risk that wires are slack to such an extent that these hit the boat. This applies as long as the boat has not been raised free above the crests of the waves.

If the mother vessel is to be kept under control, it must be under way somewhat in a forward direction, which entails that the engagement and disengagement operations as described above must be able to be put into effect while moving forwards. This makes it even more difficult to execute a launching or recovery operation of a boat using the conventional systems.

There is, thus, a need in the art for a system for the launching and recovery of boats in which the above-outlined drawbacks are obviated or at least reduced to a minimum.

SUMMARY OF THE INVENTION

The present invention comprises an apparatus, here designated a dock, in which the boat is stored on board a mother vessel, the dock being floatable. The dock is connected to davits or the like and the boat may be run out of and into the dock when the dock has been lowered to the floating position.

From publications NO 141 929 and NO 162 184, systems are already known in which boats in a lowered floating position are run into or out of special apparatuses for recovery and launching, respectively. These prior art apparatuses suffer, however, from the disadvantage that they must be lifted a relatively long distance before the boat proper begins to be lifted. As a result of the large waves which may be built up along the side of the vessel, the risk is then great that the boat moves in relation to the apparatus, in which event it may strike against parts of the apparatus, assume an oblique position inside the apparatus and capsize when the apparatus is lifted, or that hooks, lines and the like hit the boat. From the above-mentioned publication NO 162 184, it is known to employ a net for lifting the boat. This functions satisfactorily as long as the vessel is dead in the water, but if the vessel is under way or if there is a current, the risk is great that the net does not maintain its intended configuration, but behaves roughly like a trawler net. If the net is in the incorrect position, this naturally causes problems when lifting the boat.

One objective is that the floating dock and the boat should have as similar seakeeping properties as possible, which entails that the boat relatively simply may be run into and out of the dock, since the boat and the dock will have the same pattern of movement, i.e. the relative movement between the dock and the boat is slight. The dock should respond to a wave just as quickly as the boat.

Yet a further objective in systems of this type is that the boat and its associated dock or the like must rapidly be able to form a unit in order to minimize the risks of relative movement between dock and boat.

Another objective is that the system should be capable of simple adaptation to existing vessels. This is achieved in the present invention in that conventional davit systems may be employed. As a result, only minor modifications to the mother vessel are normally required. The apparatus according to the above cited NO 162 184 requires that a special two-armed crane be used.

Employing the apparatus according to the present invention, it is possible to handle all types of boats in existence today.

When, in the description below, mention is made of the forward portion of the various parts, this is taken to signify that part which, in normal use, co-operates with or is located in the forward region of the boat, and the corresponding situation applies to the rear part and similar expressions.

BRIEF DESCRIPTION OF THE DRAWING

The present invention will now be described in greater detail here below, with particular reference to various embodiments shown in the accompanying drawings, wherein.

DETAILED DESCRIPTION

Figure 1:
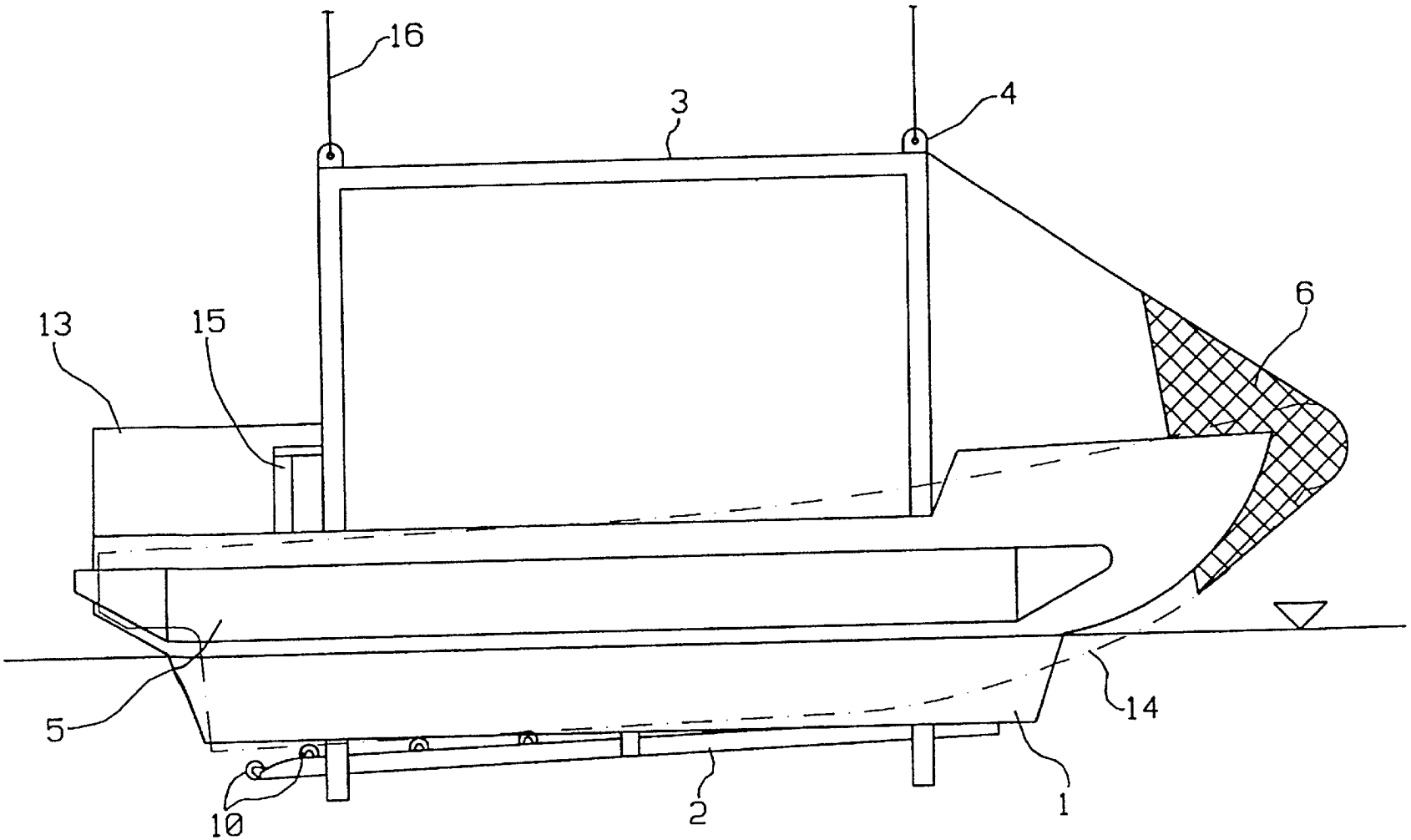
FIG. 1 is a side elevation view of one embodiment of the present invention.

The dock has one or more buoyant elements which support a cradle 2 intended for supporting and carrying a boat 14. The cradle 2 rests in a frame construction or frame 3, the frame 3 being fixed to the buoyant elements in a suitable manner.

In the illustrated embodiment, the buoyant elements consist of two buoyant bodies or pontoons 1 disposed on either side of the frame 3. In other embodiments (not shown), the buoyant elements consist of a continuous hull, two or more buoyant bodies on either side of the frame, etc.

Irrespective of the configuration and number selected, the buoyant elements must have a total displacement which is sufficient to support the dock together with a fully loaded boat 14. The buoyant elements must ensure that the dock (or more precisely the cradle) assumes the correct floating position so that the boat 14 may simply be run into and out of the dock. In addition, the buoyant elements must be of such configuration and have such displacement that the dock in its entirety has the same seakeeping properties as the boat 14. The seakeeping properties, floating position etc. of the dock are influenced by modifying the configuration and size of the buoyant elements. The dock must be given rolling and pitching periods which as closely as possible correspond to those of the boat in order to achieve similar seakeeping properties. It is not possible to state the exact configuration and size generally, but these must be arrived at by test for each specific embodiment of dock and boat 14.

Fenders 5 are disposed on the outer sides of the buoyant elements in order to damp any possible collisions against the side of the vessels. The fenders 5 are suitably made displacing, i.e. they constitute a part of the buoyant elements. One example of suitable fenders is inflated rubber fenders. The fenders 5 are provided on the outside with a wear surface, for example rubber.

Figure 2:
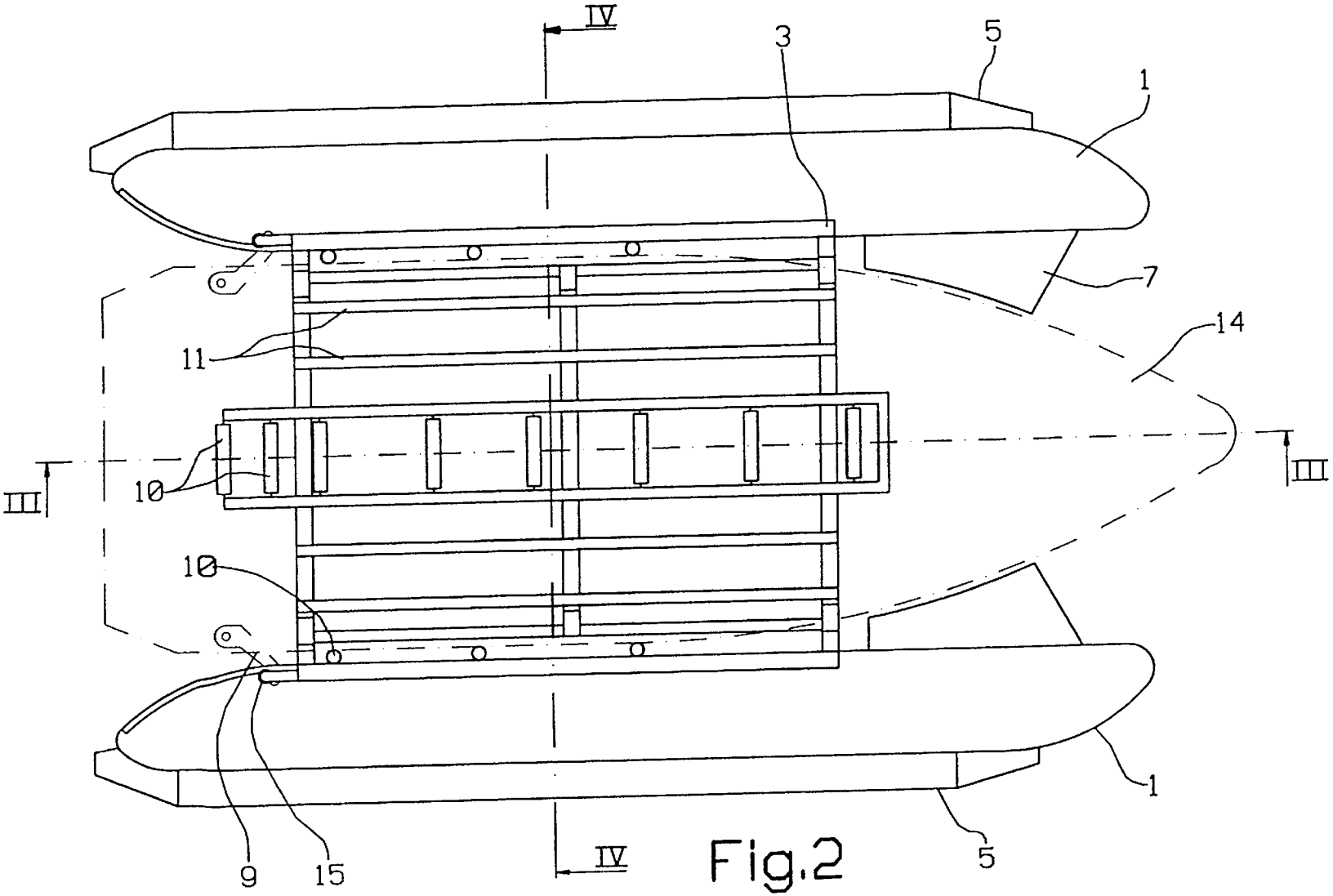
FIG. 2 is a top plan view of a modified embodiment of the present invention.
Figure 3:
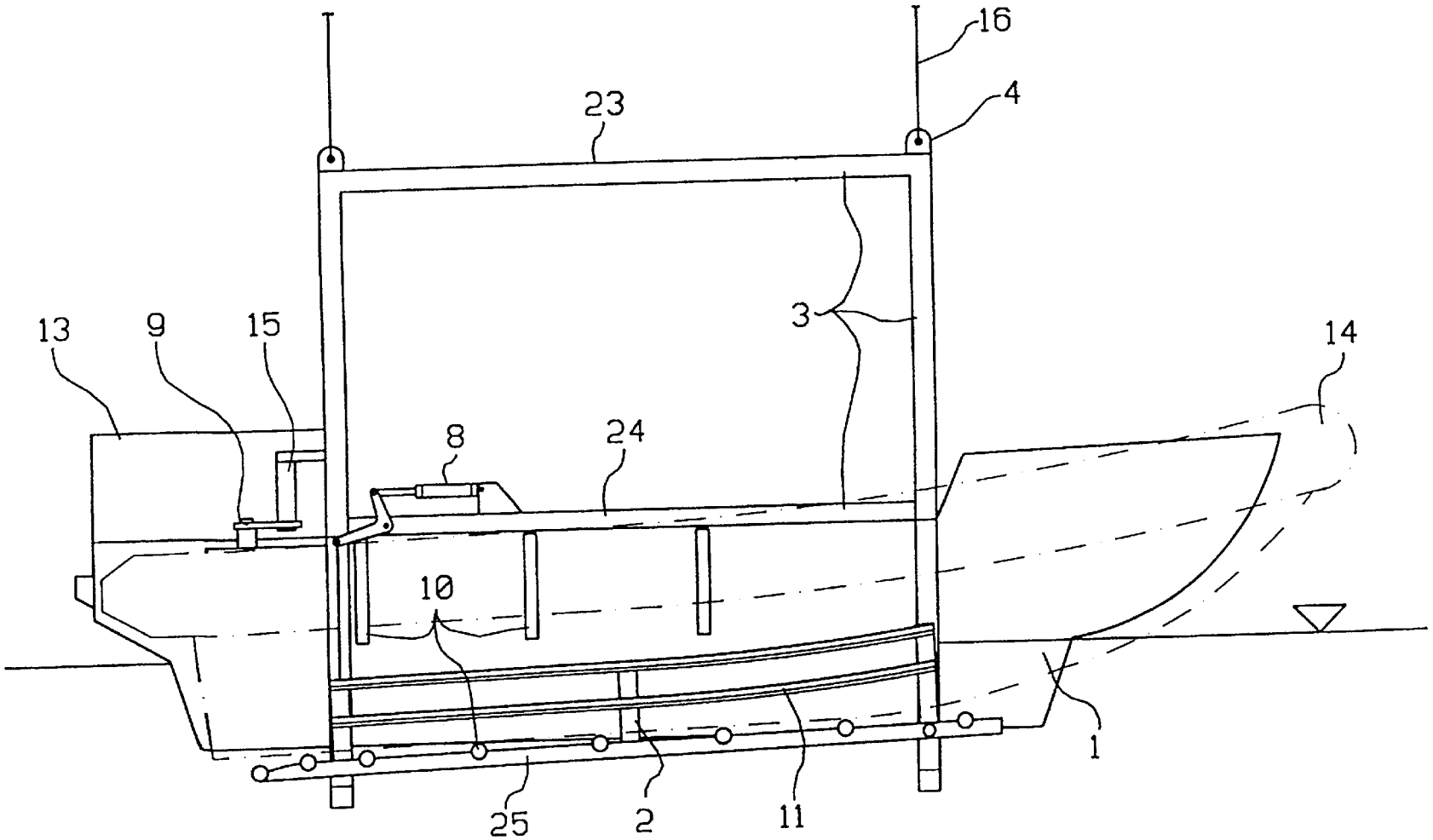
FIG. 3 is a section taken along the line III—III in FIG. 2.
Figure 4:
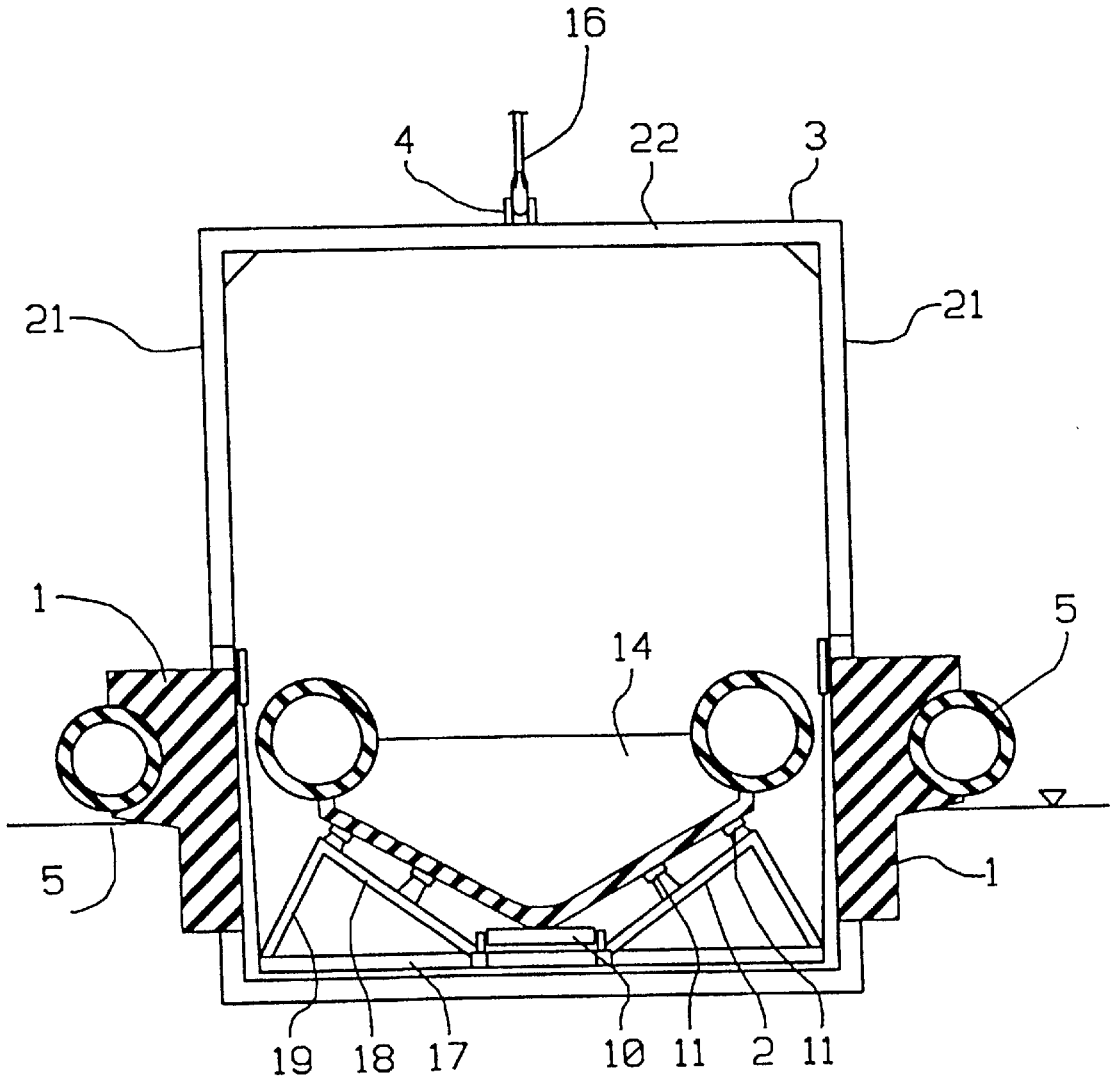
FIG. 4 is a section taken along the line IV—IV in FIG. 2.
Figure 5:
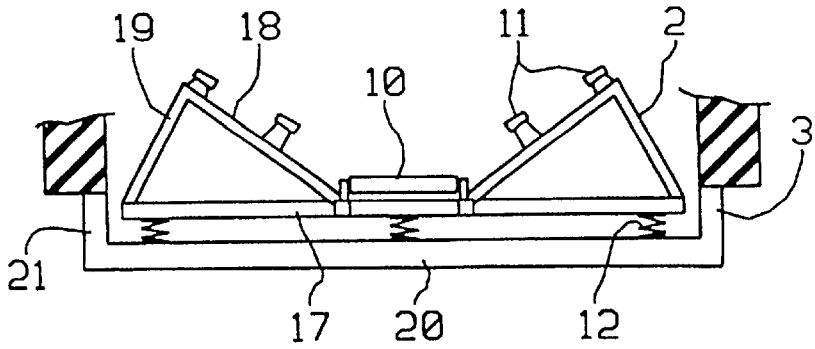
FIG. 5 is a detailed view showing one embodiment of the cradle in which the boat is received.

The cradle 2 disposed in the dock is adapted to the bottom shape of the boat 14. The boat 14 may be flat-bottomed, round-bottomed with different curvatures, or be provided with a keel of different angles, or a combination of these. In, for example, water-jet powered boats, the bottom is flat at the stern but may be rounded further forwards. In the embodiment shown in FIGS. 4 and 5, the cradle 2 is constructed from two or more transversely placed elements each consisting of a bottom beam 17, two oblique struts 18 and two edge stays 19. The inclination of the oblique struts 18 is adapted to the bottom configuration of the boat. Midway in the cradle 2, there is a set of rollers 10 disposed facing towards the boat and, on the sides of the oblique struts 18 facing towards the boat 14, one or more sliding strips 11 are disposed. Both the sliding strips 11 and the set of rollers 10 are disposed in the longitudinal direction between the elements consisting of the bottom beam 17, the oblique struts 18 and the edge stays 19. The concept is that the boat 14 should, if necessary, be capable of sliding on the rollers 10 and the sliding strips 11 when the boat is manoeuvred into or out of the dock. In FIGS. 2 and 3, rollers 10 are shown as disposed for co-operation with the outer sides of the boat in order to steer the boat in position. A person skilled in the art will perceive that, in other embodiments (not shown), use is made exclusively of rollers 10 or exclusively of sliding strips 11 or that the rollers or sliding strips, respectively, are disposed in other positions as compared with that shown in the illustrated embodiment. In order to damp the collision loading against the bottom of the boat on entry into the dock, the cradle too is, in one embodiment, resiliently mounted (FIG. 5) in the frame 3. The resilient mounting is effected by means of a number of springs 12, rubber elements or other resilient devices disposed between the bottom beams 17 of the cradle 2 and the frame construction 3. In one alternative embodiment (not shown), the cradle 2 is suspended with resilient elements in the frame construction 3.

Figure 6:
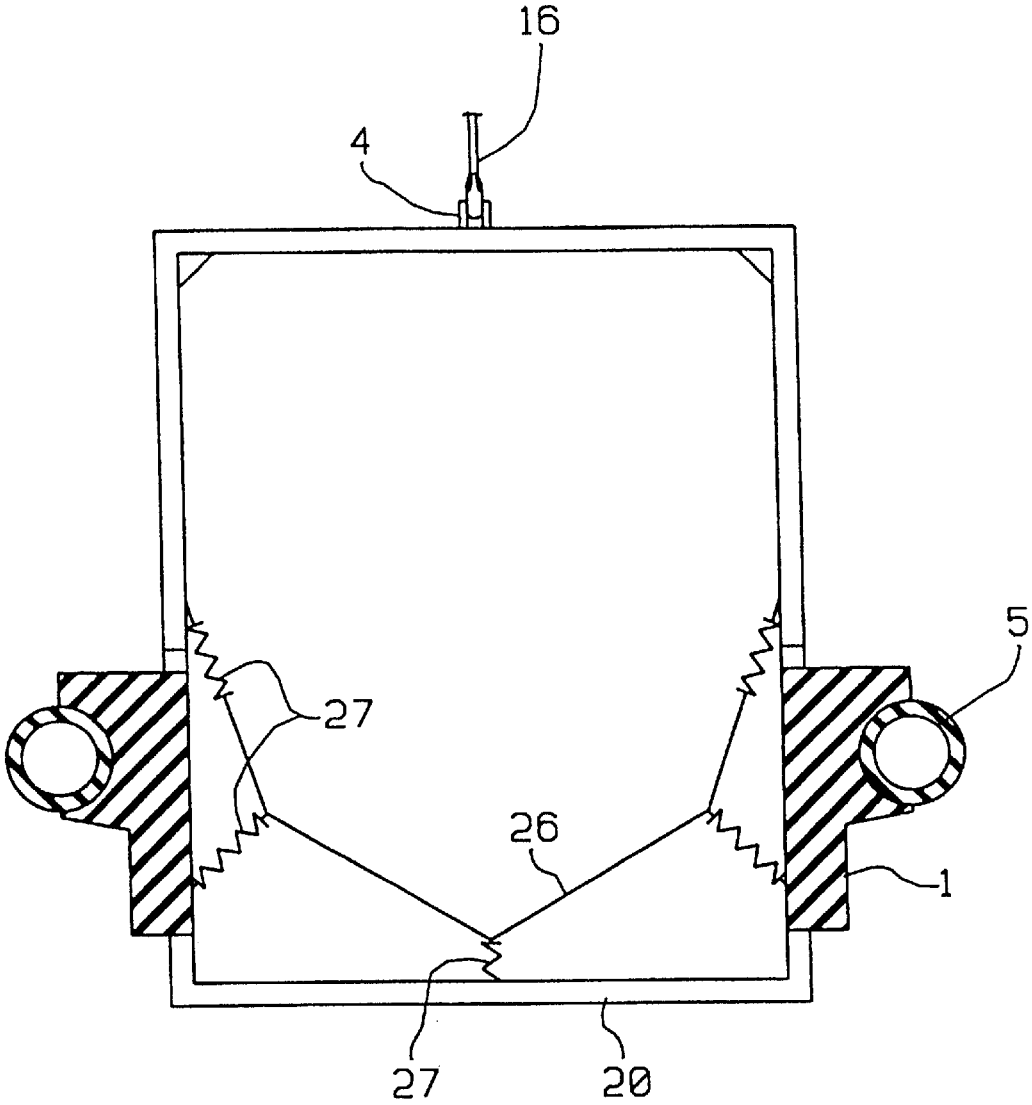
FIG. 6 is a section corresponding to that of FIG. 4 of an alternative embodiment.

In one alternative embodiment, the cradle consists of a net 26 (FIG. 6) tensioned in the frame 3 by means of springs 27 in such a manner that the net forms a cradle. In such instance, there are no rollers 10 or sliding strips 11, but the boat instead slides on the net itself. In one embodiment, the net consists of glass fibre rods interwoven with belts or lines of a suitable fibre material, including synthetic fibre of, for example, polyamide, polyester and aramide.

In further alternative embodiments (not shown) the cradle 2 consists of a bottom beam on which two or more upstanding posts are disposed. The posts normally slope somewhat inwards and are provided with rollers or support sliding strips. A person skilled in the art will perceive that the cradle 2 may be constructed in many different ways as long as it is adapted to the configuration of the boat 14.

In the illustrated embodiment, the frame construction 3 includes two or more tranversely placed elements consisting of a bottom beam 20, two side beams 21 and a crosspiece 22 which are interconnected to form a rectangle.

Between these two or more transversely placed frame elements 20–22 at least one upper interconnection beam 23 and one lower interconnection beam 25 are disposed longitudinally and connected with the side beams 21. In a number of embodiments, one or more interjacent interconnection beams 24 are moreover provided. The side beams 21 of the frame 3 are fixed to the buoyant bodies 1. A person skilled in the art will perceive that this fixing may be put into effect in a number of different ways, but given that this feature does not constitute any germane part of the present invention, it will not be described in greater detail here.

A person skilled in the art will further perceive that the construction of the frame 3 may also be varied in many ways, for example in one embodiment, the frame 3 consists only of the lower parts as described above, and in another embodiment, the cradle 2 forms the lower part of the frame 3. Furthermore, the side beams may be disposed with an inclination and/or the interconnection beams may be disposed cruciformly. In a number of embodiments, the upper or interjacent interconnection beams 23, 24 are moreover employed to suspend other details and parts such as nets, seat places, railings, etc.

In the upper part of the frame 3, anchorages 4 are provided for co-operation with winch wires 16. Provision of a permanent coupling between the winch wire 16 and the anchorages 4 eliminates the need for providing heavy hooks which, in previously employed apparatuses, were connected to the boat proper and then constituted a hazard for those persons located in the boat. In order to take up any possible slack in the wires, the winches which are employed are self-tensioning and/or so-called heave compensation is employed. As a rule, the heave compensation is based on the concept that the wires run over a spring-loaded block where the ability to take up slack is determined, int. al. by the maximum stroke lengths of the springs. As an extra safety provision, the frame construction 3 is provided, in a number of embodiments, with a roof (not shown) on which a slack cable can be received. The anchorages 4 are placed high so as to minimize the risk if the wires become slack more than the self-tensioning winches and/or heave compensation is able to take up.

In the forward part of the dock, the buoyant bodies 1 are provided with stops 7 which are directed inwards. The stops 7 are designed in correspondence with the bow section of the boat 14. The function of the stops 7 is to both guide the boat 14 so that it assumes the correct position in the cradle 2 and to prevent the boat 14 from entering in too far.

In order to facilitate entry into the dock, in a number of embodiments the dock is provided with screens 13 and/or rollers 10 which co-operate with the outer sides of the boat in order to steer the boat into the dock.

In one embodiment, the stops 7 are supplemented by a catchment net 6 placed in the forward part of the dock, the net 6 receiving the prow of the boat 14. The net is designed and journalled such that the boat is arrested gently. The catchment net is only employed together with such boats 14 in which people cannot sit furthest forward in the prow.

The boat 14 and the dock are provided with suitable, co-operating locking devices 9, 15 for fixing the boat 14 to the dock. The locking devices prevent the boat from sliding out uncontrollably from the cradle. In the illustrated embodiment, the locking devices consist of rotary hooks 9 disposed on the boat, the hooks co-operating with pins 15 disposed in the buoyant bodies 1. A person skilled in the art will perceive that this locking feature may be provided in various different ways and that the different co-operating parts may be disposed on many different points (in many different positions). In the simplest case, the locking devices consist of a rope end and a co-operating bitt or the like.

In the illustrated embodiment, the cradle 2 is journalled sloping in the frame 3, where the highest portion of the cradle 2 in relation to the water surface lies forwards in the dock. In other embodiments, the cradle 2 does not slope. Further, in certain embodiments, the cradle 2 is rotatably journalled in its forward portion, in which event a lifting device 8 is provided which lifts the rear end of the cradle 2 and, therewith, the stern of the boat 14, such that the boat 14 wholly or partly leaves the water and thereby will rest stably in the cradle 2. In yet a further embodiment, the entire cradle 2 is journalled movably in the vertical direction, in which the lifting device 8 lifts the entire cradle 2 and not only its rear portion. The lifting device 8 consists of one or more rams, actuators, etc. driven by compressed air vessels, hydraulic accumulators or electric batteries. When the catchment net 6 is employed its lines may be directly coupled to the cradle 2 in such a manner that, when the boat 14 is in the cradle and the catchment net 6 is tensioned, the entire cradle 2 or its rear portion is lifted and locked in a raised position with the aid of a locking device (not shown). In this case, the inherent kinetic energy of the boat is thus utilized for lifting the cradle. The above applies also to those embodiments in which the cradle consists of a net. In a number of embodiments, contact devices are provided in connection with the stops 7, the contact devices automatically activating the lifting device 8 when the boat 14 runs against the stops 7.

In addition to the winch wires 16 which come from the davit, the dock is connected to the mother vessel also by mooring and guide lines (not shown). On the frame 3, suitable anchorages (not shown) are provided for the mooring and guide lines. With the aid of the mooring and guide lines, the boat 14 is held in a suitable position in relation to the mother vessel and accompanies the mother vessel's possible movement forwards. The guide and mooring lines are connected to winch devices on the dock and/or the mother vessel or the guide and mooring lines have fixed connections on the dock or vessel, respectively, in which event these lines are of a fixed length.

The dock including the boat 14 and the davit is placed anywhere optionally on the vessel where it is considered suitable. It is also possible to place it in the stern, which makes for more reliable and safer towing.

When the boat 14 is to be launched, the dock is lowered with the aid of the winch devices of the davits. When the dock reaches the surface of the water and is freely floating, in embodiments provided with lifting devices as described in the foregoing, the boat 14 (or more precisely the cradle) is first lowered. The locking device 9 is then released, whereafter the boat 14 slides or backs out of the cradle 2. The buoyant elements are of a design to enable the cradle 2 to be held in such a position that, when the boat 14 has been released, it lies sufficiently deep in order, if necessary, to allow the boat 14 to reverse out from the dock. Normally, the boat 14 is in a floating position whereupon it is moved out of the dock in that the dock accompanies the mother vessel's forward movement. Moreover, the buoyant elements are designed such that, when the boat 14 has completely entered the dock (i.e. so far that its prow abuts against the stops 7 and possibly the catchment net 6), the boat 14 abuts against the dock at at least two points. In such instance, the boat 14 is supported at least intermittently in at least at one point of the cradle 2. The short distance between boat 14 and cradle 2 entails that, in the lifting movement proper of the dock, there will be at most but a slight relative movement between the cradle 2 and the boat 14. The dock is held at the side of the vessel and in a suitable position with the aid of the mooring and guide lines. Thus, the dock remains in position and floats or is in attendance in the water ready to receive the boat 14 when a mission is completed.

By providing the dock with suitable railings and possible seating places in connection to the buoyant bodies and a net beneath the cradle (or that the cradle consists of a net), it is possible to employ the dock alone for retrieving people in distress on board the mother vessel. These parts can be supported in the interconnection beams 23–25 over the frame 3. The dock may then be hoisted up without the boat being in position in the dock. This may be employed for transferring people in distress to the mother vessel at the same time as the boat 14 is used for retrieving or searching for others in distress.

When the boat 14 is once again to be taken on board the vessel, it is introduced into the dock. Given that the dock and the boat 14 have almost entirely the same seakeeping properties, thanks to the buoyant elements of the dock, it is relatively simple to run the boat 14 into the dock even in a very heavy sea. When the dock is floating in the sea without the boat, the cradle 2 lies sufficiently deep for the boat 14 to be able to enter the dock. At the same time, the cradle 2 does not lie deeper than that it intermittently supports the bottom of the boat 14 at at least one point when the boat 14 has been introduced so that its prow abuts against the stops 7 and possibly against the catchment net 6. If necessary, the cradle 2 is pressed down by the boat 14 when it is enters the dock. Immediately when the boat 14 has made contact with the stops 7 or the catchment net 6, the boat 14 is locked in position in the dock with the aid of the locking devices 9. The boat 14 and the dock thus rapidly form a cohesive unit in that they are in contact at at least two points and do not run the risk of being jolted against one another when the dock is lifted up to the vessel. If the dock is provided with lifting devices 8 for lifting up the boat 14 wholly or partly from the water, these lifting devices 8 are activated (if they have not already been activated) with the aid of the catchment net 6 or the contact devices of the stops 7. The next stage is to lift the dock with the boat 14 in the cradle 2 on board the mother vessel.

The above detailed description has referred to but a limited number of embodiments of the present invention, but a person skilled in the art will readily perceive that the present invention encompasses a large number of embodiments without departing from the scope of the appended claims.

What is claimed is:

1. Apparatus for launching and recovering a boat in water, said apparatus comprising means for providing a space into which said boat can be introduced and from which said boat can be launched by a slidable movement of said boat into and from said space, said means comprising a device for supporting the boat from below when the boat is introduced into said space, said boat being buoyant in the water, said device including buoyant elements to keep said device in floating state in the water, said buoyant elements providing seakeeping properties for said device including pitching and rolling characteristics, said boat having its own respective seakeeping properties including pitching and rolling characteristics, said buoyant elements being configured and disposed to provide said seakeeping properties of said device substantially corresponding to said seakeeping properties of the boat so that the boat and the device will have the same pattern of movement in the water while the boat is being slidably introduced into and launched from the device, said buoyant elements of said device providing reserve buoyancy for said device corresponding to the weight of said boat when fully loaded to keep the apparatus afloat when the boat has been introduced and secured in the device.

2. Apparatus as claimed in claim 1, wherein when said boat is slidably introduced into said space, said boat abuts against the device at least at two points, said apparatus further comprising locking means for securing the boat to said device when the boat has been introduced into said space.

3. Apparatus as claimed in claim 1, wherein said buoyant elements comprise at least two pontoons.

4. Apparatus as claimed in claim 1, wherein said device comprises a cradle having a configuration corresponding to a bottom of said boat and serving as a slideway for introducing and launching said boat.

5. Apparatus as claimed in claim 4, comprising means between the boat and the cradle to promote slidable introduction and removal of the boat relative to the cradle.

6. Apparatus as claimed in claim 5, wherein the means to promote slidable introduction and removal of the boat comprises a plurality of rollers between the boat and the cradle.

7. Apparatus as claimed in claim 5, wherein the means to promote slidable introduction and removal of the boat comprises sliding surfaces between the boat and the cradle.

8. Apparatus as claimed in claim 4, wherein said cradle has a forward end to receive the bow of the boat when the boat is slidably introduced into said space, said forward end being higher than a rear end of the cradle so that the bow of the boat is lifted when fully introduced into said space.

9. Apparatus as claimed in claim 8, comprising a frame secured to said buoyant elements, said cradle being secured to said frame to raise and lower at least said rear end of the boat during launching and introduction of the boat into and from said cradle.

10. Apparatus as claimed in claim 9, comprising an anchorage on said frame for cooperating with wires from a crane or davit.

11. Apparatus as claimed in claim 9, comprising a lifting device connected to the frame and the cradle to lift the cradle and the boat therewith out of the water when the apparatus is floating in the water.

12. Apparatus as claimed in claim 11, wherein said lifting device comprises a piston and cylinder combination.

13. Apparatus as claimed in claim 8, comprising a frame secured to said buoyant elements and springs between said cradle and said frame.

14. Apparatus as claimed in claim 1, wherein said device comprises a net and devices to tension said net so that the net cradles the boat.

15. Apparatus as claimed in claim 1, comprising stops on said buoyant elements to limit introduction of said boat into said space.

16. Apparatus as claimed in claim 15, wherein said stops are shaped to engage the bow of the boat to guide the bow to a limit position.

17. Apparatus as claimed in claims 16, comprising a catchment net at a front of the device for being engaged by the bow of the boat and tensioned thereby when the boat is slidably introduced to said limit positioned.

18. Apparatus as claimed in claim 17, wherein said catchment net is connected to said device so as to be engaged by the bow of the boat when introduced into the device to lift the bow of the boat by kinetic energy of the boat.

19. Apparatus as claimed in claim 16, wherein said stops activate said lifting device when the bow of the boat contacts said stops.

20. Apparatus as claimed in claim 1, comprising protective fenders on said buoyant elements.

21. Apparatus as claimed in claim 20, wherein said fenders are themselves buoyant.

22. Apparatus as claimed in claim 1, wherein said buoyant elements comprise a cohesive hull.

23. Apparatus as claimed in claim 1, further comprising locking means for locking said boat in said device when introduced therein so that when said boat has been introduced into said device, said boat is adapted to be secured to said device to form a unit therewith which is in floating condition in the water.

24. Apparatus as claimed in claim 1, wherein said boat is adapted as a lifeboat and said device is a vessel provided with said buoyant elements, said boat being adapted to be stored on said vessel as a unit after introduction into said space and being launched from said vessel by slidable movement therefrom when the vessel and boat are in the water as a unit and each has substantially the same seakeeping properties in the water.

25. Apparatus as claimed in claim 2, comprising means for locking the lifeboat to the vessel as a unit when the lifeboat has been introduced thereinto and means for lifting said unit from the water for storage on a ship or platform and for lowering said unit into the water when the lifeboat is to be launched.

* * * * *